US006305637B1

(12) United States Patent
Back

(10) Patent No.: US 6,305,637 B1
(45) Date of Patent: Oct. 23, 2001

(54) YARN DISPENSING APPARATUS

(75) Inventor: Diana Back, 2999 9th St., Columbus, IN (US) 47201

(73) Assignee: Diana Back, Columbus, IN (US)

( * ) Notice: Subject to any disclaimer, the term of this patent is extended or adjusted under 35 U.S.C. 154(b) by 0 days.

(21) Appl. No.: 09/550,427

(22) Filed: Apr. 17, 2000

(51) Int. Cl.[7] ..... B65H 49/26; B65H 75/18

(52) U.S. Cl. ..... 242/597.6; 242/127; 242/139; 242/597.7

(58) Field of Search ..... 242/127, 129, 242/139, 146, 597.6, 597.7

(56) References Cited

U.S. PATENT DOCUMENTS

| | | | | |
|---|---|---|---|---|
| 441,454 | * | 11/1890 | Vileyn | 242/129 X |
| 2,246,713 | * | 6/1941 | Benson | 242/139 X |
| 2,254,468 | * | 9/1941 | Benson | 242/139 X |
| 2,847,172 | * | 8/1958 | Salkield | 242/129 |
| 3,302,899 | * | 2/1967 | Keyser | 242/597.6 X |
| 4,010,600 | * | 3/1977 | Poole et al. | 242/597.6 X |
| 4,112,711 | * | 9/1978 | Tripp | 242/141 X |
| 4,634,077 | * | 1/1987 | Wilson | 242/139 |
| 5,042,737 | * | 8/1991 | Sigle et al. | 242/129 X |
| 5,842,655 | | 12/1998 | McCarthy . | |
| 5,975,458 | | 11/1999 | Goldthreate . | |

FOREIGN PATENT DOCUMENTS 2 135 346-A * 8/1984 (GB) ..... 242/597.7

* cited by examiner

*Primary Examiner*—Michael R. Mansen
(74) *Attorney, Agent, or Firm*—Baker & Daniels

(57) ABSTRACT

An apparatus for dispensing yarn from a skein for knitting and crocheting includes a base, a support, and a spool which carries the yarn. The spool includes a hollow elongated tube which is positioned over the support. In one embodiment, the support has a tapered upper end and the upper end of the elongated tube is closed. So positioned, the spool rotates about the support as yarn is drawn by the user. The spool also includes a platform near the lower end for holding a skein of yarn. The components are sized such that the spool has sufficient length to accommodate skeins of varying lengths. The overall length of the support is at least slightly longer than the overall length of the spool. In a preferred embodiment, the support is removable to allow varying support and spool combinations to be used if desired. The invention presents an apparatus which is easy and convenient to use and which provides for the tangle free delivery of yarn as needed by the user.

9 Claims, 4 Drawing Sheets

YARN DISPENSING APPARATUS

FIELD OF THE INVENTION

The invention relates to a handcraft apparatus for holding and dispensing yarn for knitting and crocheting. The apparatus presents an inexpensive and easy to use device for the tangle free delivery of yarn as required by the user.

BACKGROUND OF THE INVENTION

When knitting or crocheting, the yarn is typically drawn from a ball or skein placed on the floor. Significant drawbacks are inherent in this situation. The ball or skein is largely uncontrolled allowing them to roll or move around thus requiring the knitter to periodically stop and retrieve them. In addition, certain pets, particularly of the feline persuasion, are known to consider such things as a ball of yarn as playthings and will engage the artisan in games of fetch or keep-away requiring the knitter or crocheter to stop their craft-work and vie for control of the yarn. With the uncontrolled unraveling of the yarn, from whatever cause, tangling invariably occurs causing further disruption to the process.

It is recognized by knitters and crocheters that yarn is more likely to tangle if used from the skein as purchased than if it is unwound from its original skein and rewound on a spool of some sort For some knitters and crocheters, it is preferable to rewind the yarn even though this introduces an extra step in the knitting or crocheting process. There is therefore an opportunity for significant time savings if yarn can be used directly in skein form. For this reason, most of the inventions developed to solve these problems are intended to work with yarns in skein form.

The inventions that have been made to address these primary problems typically involve the insertion of a rod through the skein with the rod being either horizontally or vertically mounted so as to allow rotation of the skein. The goal with these devices is basically to control the movement of the skein to prevent or at least minimize tangling of the yarn and to control the rate of delivery of the yarn.

The simplest of these devices is depicted in U.S. Pat. No. 4,059,243 to Hartley which discloses a base member with hinged and foldable end members with a horizontal rod positioned between the end members. The rod is inserted through the skein and the yarn simply pulled off as needed.

A step-up is the device depicted in U.S. Pat. No. 4,909,457 to Johnson which encloses the skein-carrying rod or spindle inside top and bottom semi-cylindrical shells. The bottom portion acts as a base holding the spindle and skein. The top portion, which includes a carry handle, closes over the bottom portion.

The device of U.S. Pat. No. 5,842,655 to McCarthy, supports the skein vertically and is intended to provide a device which can be used with any size or skein configuration and includes a guide mechanism to route yarn to the user.

All of these devices achieve some measure of success; however, there is still a need for a device that is easy and convenient to use while holding and controlling the yarn during the dispensing operation.

BRIEF SUMMARY OF THE INVENTION

The present invention provides an apparatus for holding and dispensing yarn for knitting or crocheting. The invention is designed to deliver yarn from a skein without tangling. Yarn is drawn from the skein by the user as needed. The device is configured to sit on a level surface such as a table top or floor in close proximity to the user.

In the preferred embodiment, the dispenser includes a base member having a recess or cavity at its approximate center for the attachment of a support member. In one embodiment of the invention, the upper end of the support member has a tapered tip. In another embodiment, the upper end of the support member has a rounded tip. A spool, which includes a tube having a closed upper end is lowered onto the support so that the closed upper end of the tube rests on the end of the support member so that the tube can rotate about the support member as yarn is drawn from the spool. A platform for holding the skein is attached to the lower portion of the tube. In one embodiment, the platform sits atop a platform support member attached to the tube which forms a shoulder to help support the platform.

The elements are sized so that the inner diameter of the tube is slightly greater than the diameter of the support member. Additionally, the overall length of the tube is most preferably slightly less than the length of the support member. The tube length above the platform should be sufficient to pass completely through a skein of yarn. The outer diameter of the tube must be sufficiently small to pass through a skein of yarn. The diameter of the platform should be approximately the diameter of the largest skein to be placed thereon.

In the preferred embodiment of the invention, the support member is removable from the base. This gives the user the ability to interchange support members and spools as the need arises. This also facilitates the storage or transport of the dispenser.

Accordingly, a primary object of the present invention is to provide an improved apparatus for the continuous uninterrupted dispensing of yarn which is easy and convenient to use. A further object is to provide an apparatus which can be easily assembled and disassembled should storage or transportation of the device be desired. These and other objects, advantages, and benefits are accomplished according to the devices of the following descriptions of the preferred embodiments of the present invention.

DESCRIPTION OF THE PREFERRED EMBODIMENTS

Figure 1:
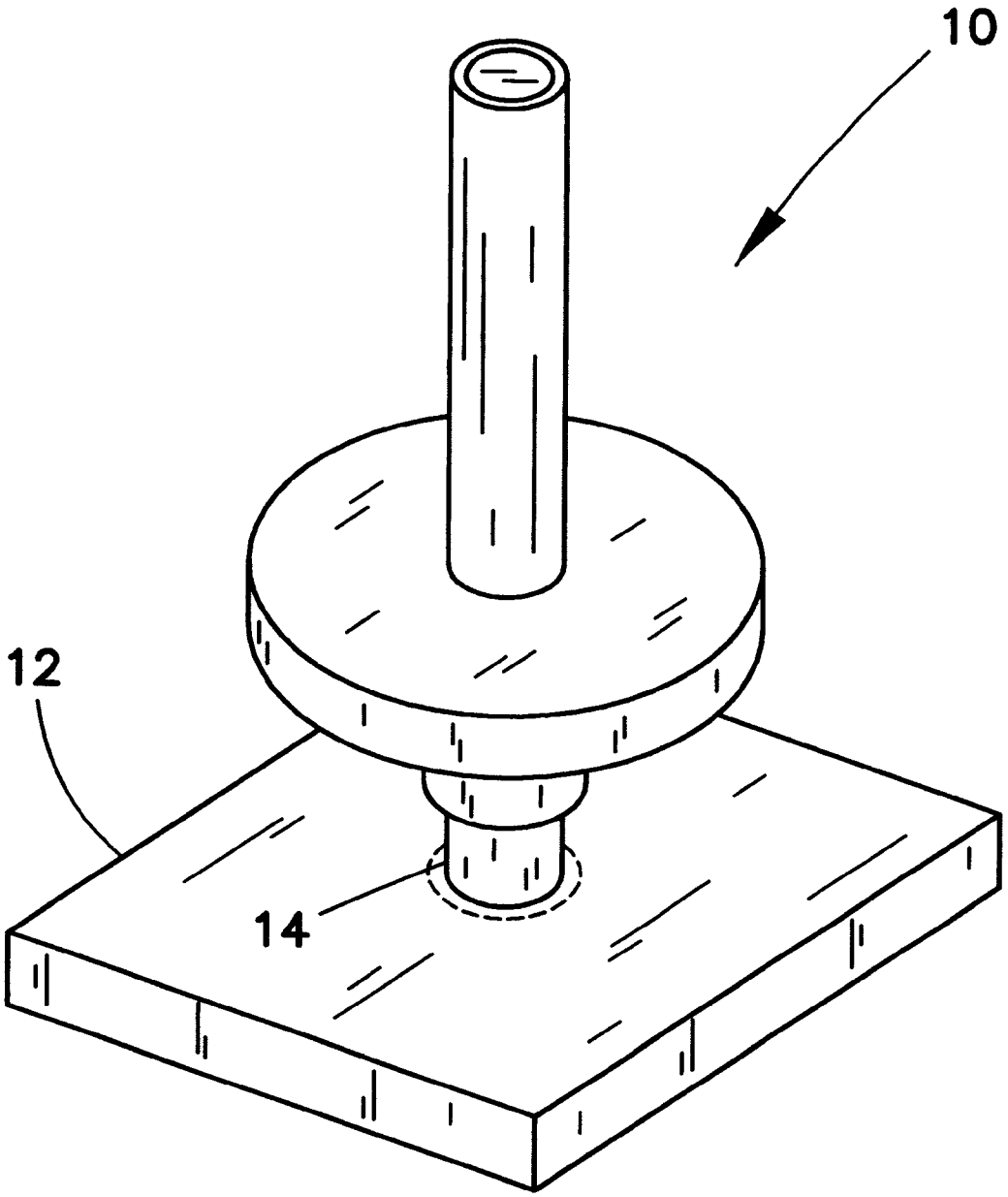
FIG. 1 is a front perspective view of the yarn dispensing apparatus according to one embodiment of the invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides an improved apparatus for the holding and dispensing of yarn which is convenient and easy to use. The yarn is delivered without tangling as it is drawn by the user as needed.

Referring to the drawings, an apparatus for the holding and dispensing of yarn in accordance with the preferred embodiment of the invention is illustrated in FIG. 1. The device 10 includes a base 12 which is intended to rest on a substantially horizontal surface such as a floor or table top in relatively close proximity to the knitter or crocheter. The base 12 is preferably made of a relatively heavy material such as wood or plastic to support the device against tipping over.

Figure 2:
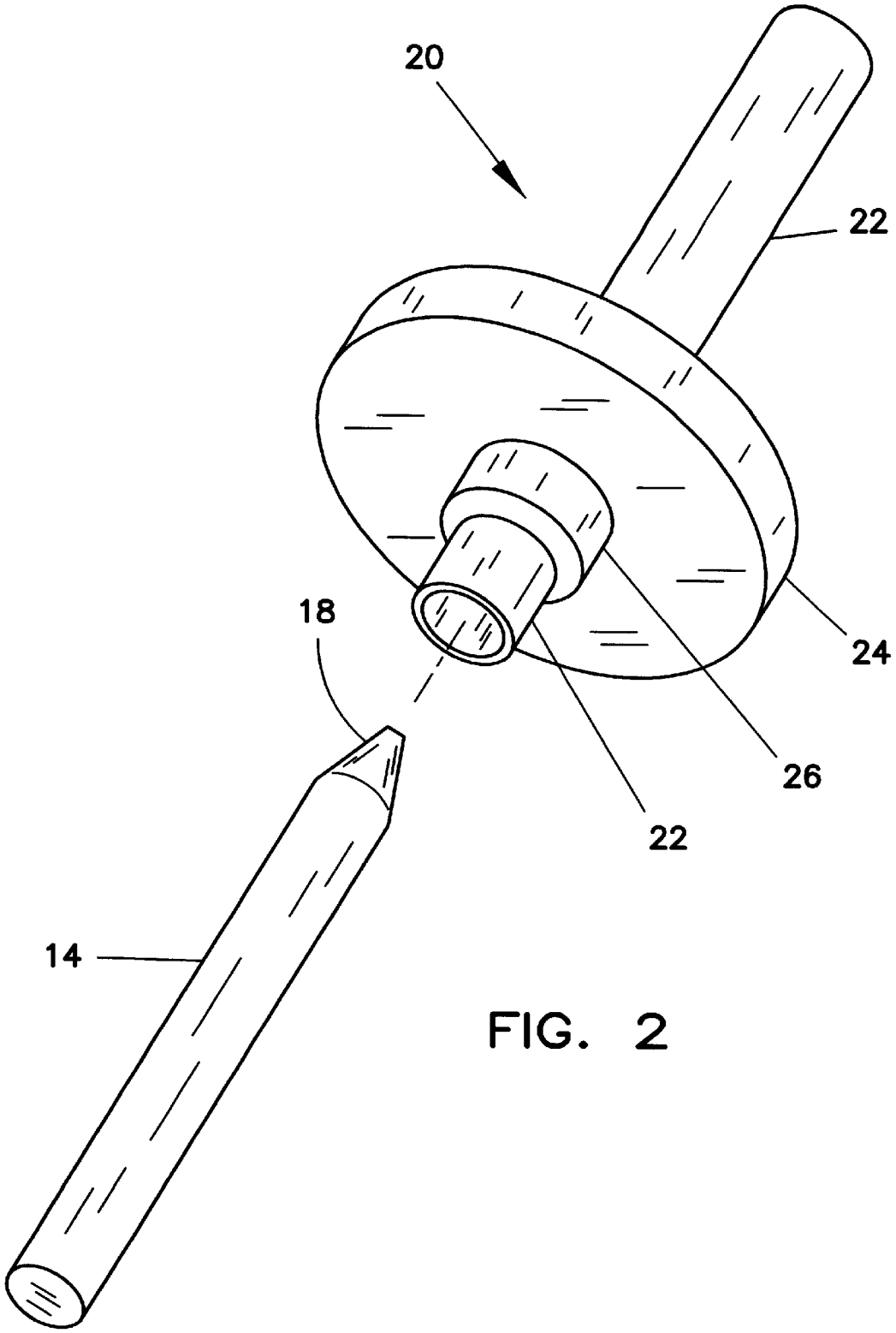
FIG. 2 is a partially exploded view showing the relationship between the support member and the spool assembly.
Figure 4:
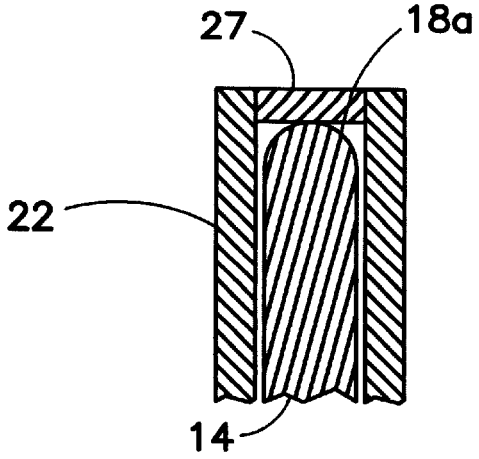
FIG. 4 is a cross sectional view of a first alternative method of engagement of the support member and spool according to the present invention.

A support 14 is mounted in the approximate center of the base 12. In the preferred embodiment, the support 14 is removable so that supports of different lengths can be used. As shown in FIG. 2, the upper end 18 of the support 14 is a point of suspension and pivot point for the spool assembly 20. In the preferred embodiment, the upper end 18 of the support 14 has a tapered tip. In another embodiment, the upper end 18*a* of support 14 could have a rounded tip as shown in FIG. 4. Most preferably, the upper end 18 is configured for low-friction support of the spool assembly 20.

Figure 3:
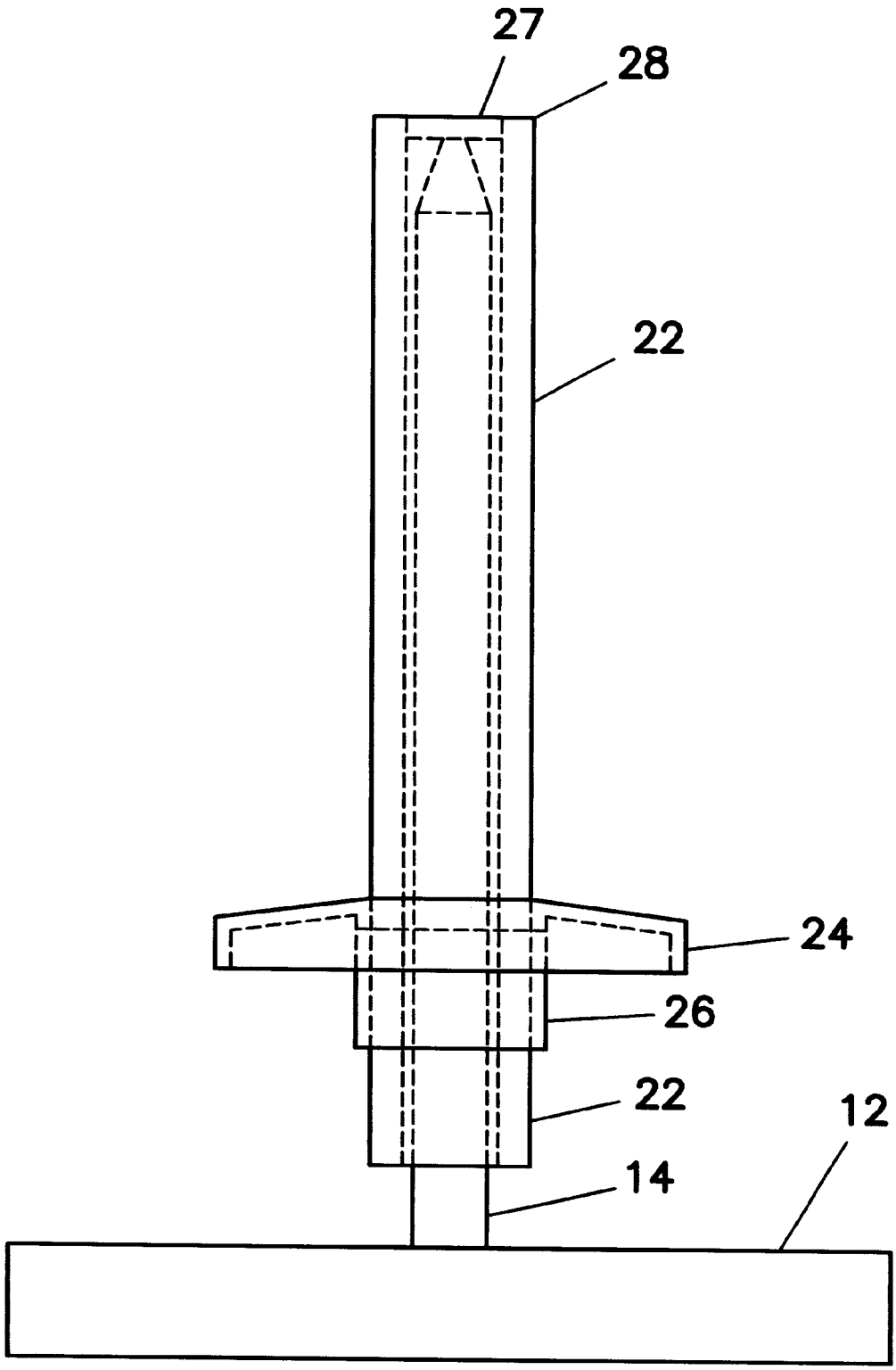
FIG. 3 is a front elevational view of the yarn dispensing apparatus according to one embodiment of the invention.
Figure 5:
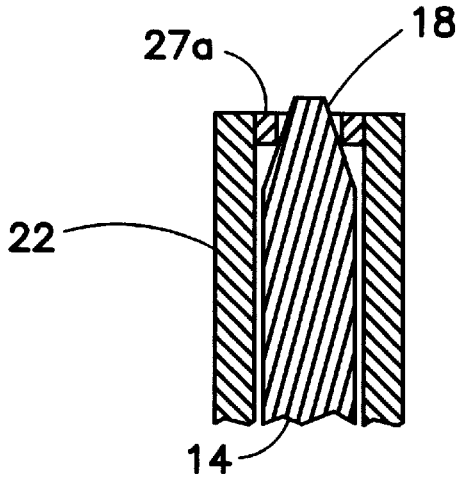
FIG. 5 is a cross sectional view of a second alternative method of engagement of the support member and spool according to the present invention.
Figure 6:
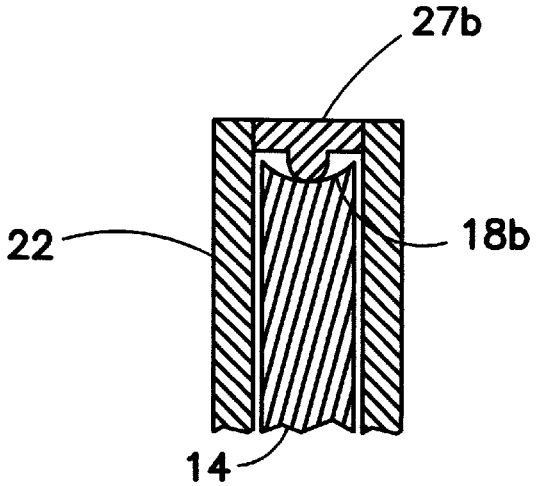
FIG. 6 is a cross sectional view of a third alternative method of engagement of the support member and spool according to the present invention.

Referring to FIGS. 2 and 3, the spool assembly 20 can include an elongated tube 22 which is open at its lower end for entry of the support 14. In the preferred embodiment, the upper end 28 of the tube 22 is capped closing the tube. The cap 27 can be integral with the tube 22 or can be threaded, pressed or snap fitted into the end of the tube 22. In another embodiment, the cap 27*a* (see FIG. 5) could define an opening or hole having a diameter less than the diameter of the support 14 without impairing operation of the spool. In yet another embodiment, the cap 27*b* could include a tapered or rounded projection in combination with a support member 14 having a concave upper end 18*b* as depicted in FIG. 6. The length of the tube 22 is preferably slightly less than the length of the support 14 to allow for rotation of the tube 22 about the support 14. The outer diameter of the tube 22 is sized to pass through a skein of yarn (not shown). The tube 22 can be provided in an array of outer diameters and lengths in accordance with the skein of yarn supported thereon.

The spool assembly 20 also includes a platform 24 which supports the skein of yarn. The platform 24 is preferably permanently attached to the lower end of the tube 22. In the preferred embodiment, the platform 24 is substantially circular with a diameter slightly larger that the diameter of a skein of yarn. As with the tube 22, a range of platform diameters can be provided depending on the size of the skein. In the preferred embodiment, the platform 24 is beveled downward from the tube 22. This feature facilitates the dispensing of yarn from the shoulder area of the skein.

In a most preferred embodiment, a platform support member 26 can be included. The platform support member 26 is also preferably permanently attached to the tube 22 and forms a shoulder which provides additional support for the platform 24. In some embodiments, only the platform support 26 is fixed to the tube 22. The platform 24 then can be slidably mounted over the tube 22 to rest on and be supported by the support 26.

In use, a skein of yarn is placed on the spool platform 24. Preferably, the support 14 and spool are selected so that the length of the tube 22 extending above the platform 24 is sufficient to completely pass through the skein of yarn. The dispenser then supplies yarn to the knitter or crocheter as needed. The user does not have to stop to draw yarn from the spool; rather, the spool rotates dispensing yarn in response to normal knitting or crocheting motions requiring very little extra activity from the user.

While the invention has been described with a certain degree of particularity, it is apparent that variations and modifications can be made with the attainment of all the advantages of the invention without departing from the spirit and scope of the invention disclosed. It is understood that the invention is not limited to the embodiments set fourth herein for purposes of exemplification, but is to be limited only by the scope of the attached claims, including the full range of equivalency to which each element thereof is entitled.

What is claimed is:

1. A yarn dispensing apparatus, comprising:

a base member having an upper surface;

an elongated support member connected to said upper surface of said base member at a first end, said support member having a diameter and a second end defining a pivot;

a hollow spool sized to fit over said support member and having an upper surface configured for pivoting engagement with said support member, said spool being adapted to removably support a skein of yarn; and wherein said pivot comprises a tapered tip and said upper surface of said spool defines a hole, said hole having a diameter less than the diameter of said support member, and wherein said tapered tip extends at least partially into said hole in pivoting engagement therewith.

2. The apparatus of claim 1 wherein said upper surface of said base defines a recess therein and said support member has a first end configured to be supported within said recess of said base member.

3. The apparatus of claim 2 wherein said support member is removably supported within said recess of said base member.

4. The apparatus of claim 1 wherein said support member has a length and said spool further includes:

an elongated tube having an upper end and a lower end, said tube being open at its lower end to receive said support member and said upper end including said upper surface of said spool and said tube having a length slightly less than the length of said support member allowing for pivoting of said tube about said support member.

5. The apparatus of claim 4 wherein said spool further includes a circular platform, having upper and lower sides, connected to said lower end of said tube for supporting a skein.

6. The apparatus of claim 5 wherein said platform is beveled downward from said tube.

7. The apparatus of claim 5 wherein said platform is fixedly attached to said lower end of said tube.

8. The apparatus of claim 4 wherein said spool further includes a platform support member fixedly attached to said support member and connected to said lower side of said platform to provide additional support for said platform.

9. A yarn dispensing apparatus, comprising:

a base member having an upper surface;

an elongated support member connected to said upper surface of said base member at a first end, said support member having a diameter and a second end defining a pivot; and a hollow spool sized to fit over said support member and having an upper surface configured for pivoting engagement with said support member, said spool being adapted to removably support a skein of yarn; and wherein said pivot comprises a concave surface and said upper surface of said spool includes a rounded projection for engagement with said concave surface.

* * * * *